US012274909B1

(12) United States Patent
Mull

(10) Patent No.: US 12,274,909 B1
(45) Date of Patent: Apr. 15, 2025

(54) ANKLE STRAP WEIGHT SECUREMENT DEVICE

(71) Applicant: Geoffrey Q. Mull, Whites Creek, TN (US)

(72) Inventor: Geoffrey Q. Mull, Whites Creek, TN (US)

( * ) Notice: Subject to any disclaimer, the term of this patent is extended or adjusted under 35 U.S.C. 154(b) by 177 days.

(21) Appl. No.: 17/942,588

(22) Filed: Sep. 12, 2022

Related U.S. Application Data

(63) Continuation-in-part of application No. 29/826,359, filed on Feb. 11, 2022.

(51) Int. Cl.
*A63B 21/00* (2006.01)
*A63B 21/065* (2006.01)
*A63B 21/072* (2006.01)

(52) U.S. Cl.
CPC ..... *A63B 21/4013* (2015.10); *A63B 21/065* (2013.01); *A63B 21/00061* (2013.01); *A63B 21/0726* (2013.01)

(58) Field of Classification Search
CPC ..... A63B 21/065; A63B 21/4013; A63B 21/0004; A63B 21/00058; A63B 21/00061; A63B 21/072; A63B 21/0726; A63B 21/4015
See application file for complete search history.

(56) References Cited

U.S. PATENT DOCUMENTS 4,728,103 A * 3/1988 Fulton ..... A63B 23/085 482/125
9,868,014 B1 1/2018 Lake
10,843,030 B2 * 11/2020 Long ..... A63B 21/065
10,881,895 B2 * 1/2021 Gubera ..... A63B 23/04
2010/0050477 A1 3/2010 Zeek
2012/0028766 A1 * 2/2012 Zeek ..... A63C 17/262 482/105

(Continued)

FOREIGN PATENT DOCUMENTS

WO WO-2015076529 A1 * 5/2015 ..... A63B 21/0004

OTHER PUBLICATIONS

Monkey Feet, retrieved on Feb. 11, 2022 from: https://animalhousefitness.com/products/monkeyfeet; publication date unknown; 25 pp.

(Continued)

*Primary Examiner* — Megan Anderson
(74) *Attorney, Agent, or Firm* — Law Office of Sam Sokhansanj PLLC

(57) ABSTRACT

An exercise ankle strap for securement to a weight that is lightweight, portable, cost-effective, machine washable, comfortable to wear, and simple to manufacture, among other advantages. The ankle strap can include a body having a front face, a rear face, a first end, and a second end. In addition, the ankle strap can include a first fastener secured to the front face of the body, wherein the first fastener extends from the first end to the second end of the body. Further the ankle strap can include a side strap secured to the body, and a second fastener secured to the first strap. Also, the first and second fasteners can include hook and loop fasteners. Further, the side strap may be coupled to the first end or second end of the body. Alternatively, the side strap may be coupled to the body from the first end to the second end.

9 Claims, 8 Drawing Sheets

(56) References Cited

U.S. PATENT DOCUMENTS

| | | | | |
|---|---|---|---|---|
| 2014/0194259 | A1* | 7/2014 | Alpert | A63B 21/065<br>482/105 |
| 2018/0099174 | A1* | 4/2018 | Biggs | A43C 19/00 |
| 2023/0381571 | A1* | 11/2023 | Sasano | A63B 23/10 |

OTHER PUBLICATIONS

Iron Ankles, retrieved on Feb. 11, 2022 from: https://www.ironankles.com/; publication date unknown; 2 pp.

* cited by examiner

ANKLE STRAP WEIGHT SECUREMENT DEVICE

CROSS REFERENCE TO RELATED APPLICATIONS

This application is a continuation-in-part (CIP) of U.S. Non-Provisional application Ser. No. 29/826,359 filed on Feb. 11, 2022, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

While exercises for the upper body are readily available, exercises for the lower body and legs have been fewer and generally more difficult to coordinate and implement. One of the reasons for this discrepancy is the simple ability of a person to pick up and put down weights with their hands, while no such ability exists for leg exercises, such as for leg extensions. This problem is typically addressed with the use of large weight-lifting machines, such as leg curl and leg extension machines that take up a lot of space, are typically found in large gyms, are expensive, and are only capable of performing a couple of exercises.

Hence, what is needed is a simple method of attaching weights to one's leg in order to perform various types of lower body and leg exercises.

BRIEF SUMMARY

In one aspect of the disclosure described herein, an exercise ankle strap is disclosed that allows a user to easily and quickly secure a dumbbell weight to the user's foot and/or ankle in order to perform various types of lower body and leg exercises. Further, the exercise ankle strap of the disclosure described herein is lightweight, portable, cost-effective, machine washable, comfortable to wear, and simple to manufacture, among other advantages.

In another aspect of the disclosure described herein, an exercise ankle strap for securement to a weight is disclosed. The ankle strap can include a body having a front face, a rear face, a first end, and a second end; a first fastener secured to the front face of the body, wherein the first fastener extends from the first end to the second end of the body; a side strap secured to the body; and a second fastener secured to the first strap. In addition, the first and second fasteners can include hook and loop fasteners. Further, the side strap may be coupled to the first end or second end of the body. Alternatively, the side strap may be coupled to the body from the first end to the second end. In addition, a first strap and a second strap can be coupled to the body, wherein the first strap and second strap extend below the body and each can be configured to at least partially wrap around a weight. Further, a third strap and a fourth strap can be coupled to the body, in addition to a third fastener and a fourth fastener, wherein the third fastener is coupled to the third strap and the fourth fastener is coupled to the fourth strap.

In addition, the third strap can be at least partially received within the third fastener and the fourth strap is at least partially received within the fourth fastener. Further, the ankle strap can include a fifth fastener coupled to the first strap; and a sixth fastener coupled to the second strap. Moreover, the third fastener can at least partially receive the fifth fastener, and the fourth fastener can at least partially receive the sixth fastener. Further, the third strap and the fourth strap can be disposed between the first strap and the second strap. In addition, the third strap and the fourth strap can each be shorter in length relative to the first strap and the second strap.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
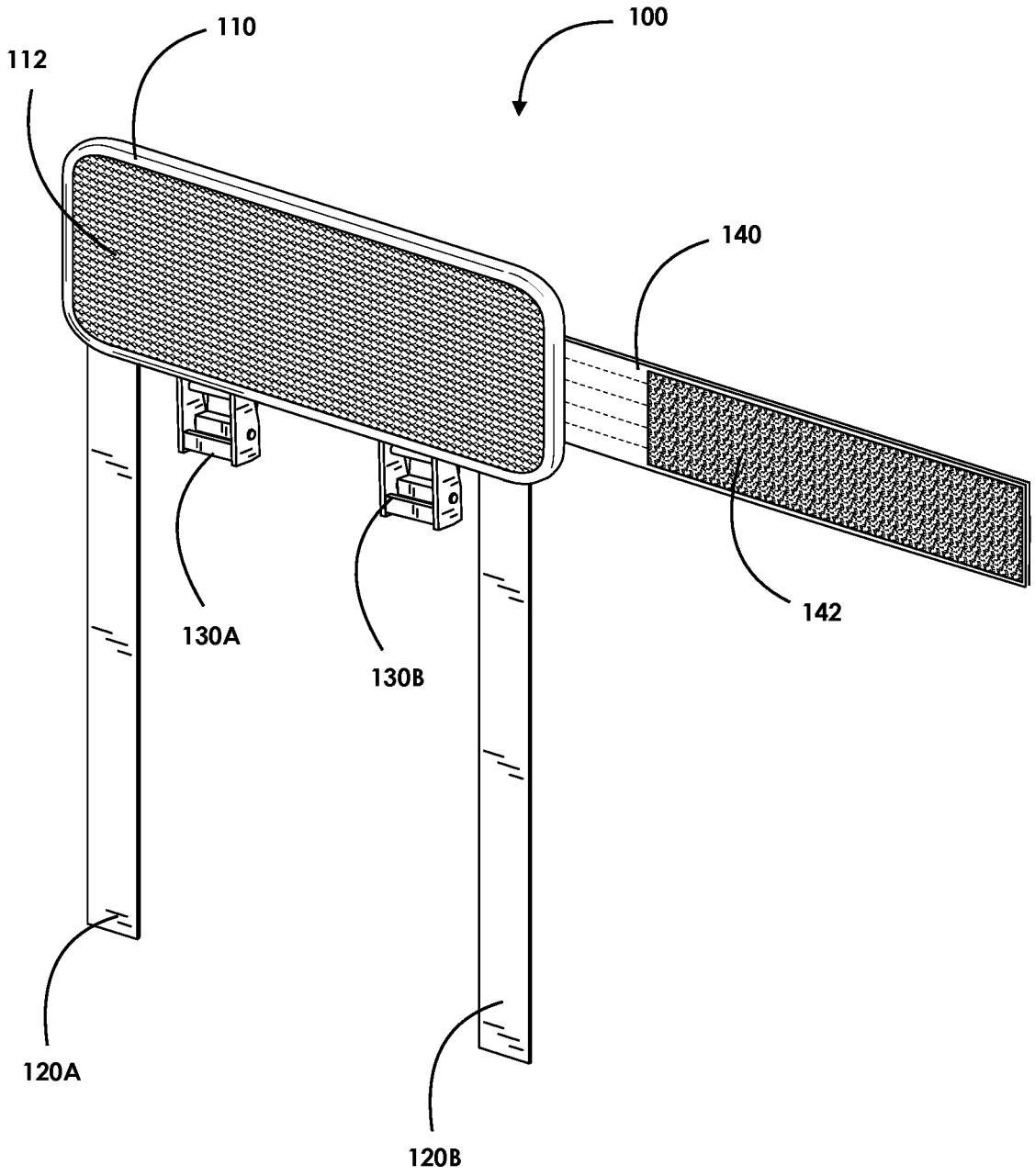
FIG. 1 illustrates a perspective view for one non-limiting exemplary embodiment for the ankle strap of the disclosure described herein.
Figure 2A:
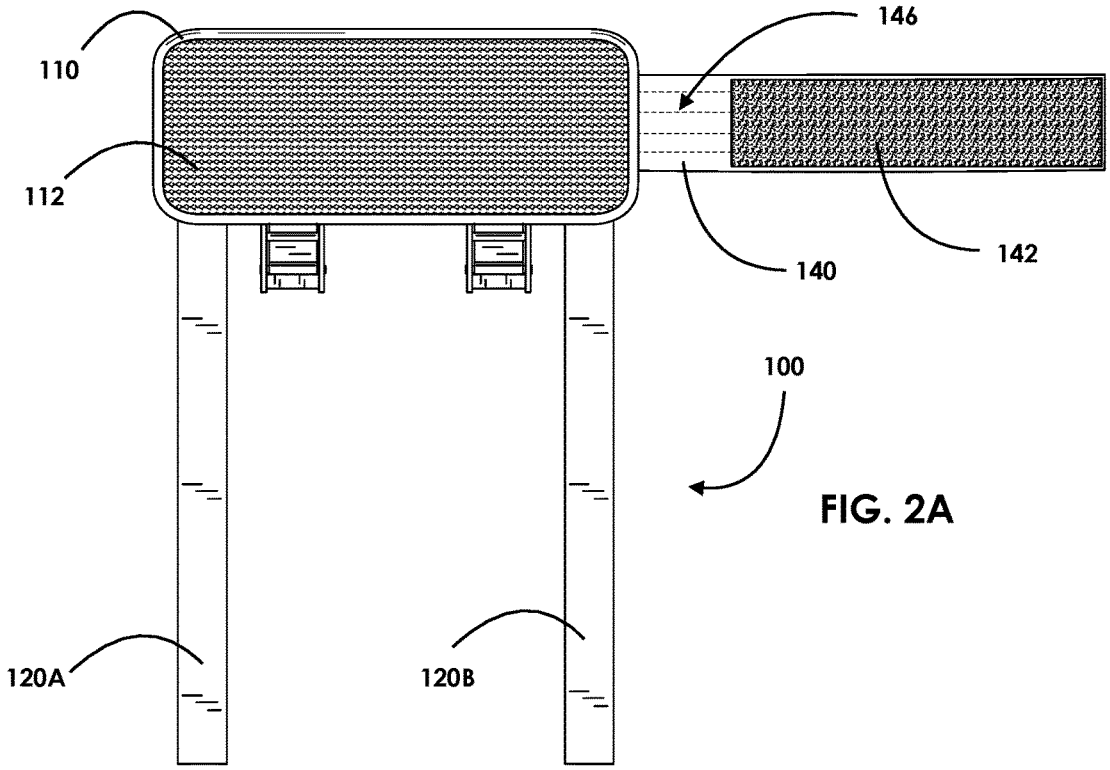
FIG. 2A illustrates a rear view for the ankle strap of FIG. 1.
Figure 2B:
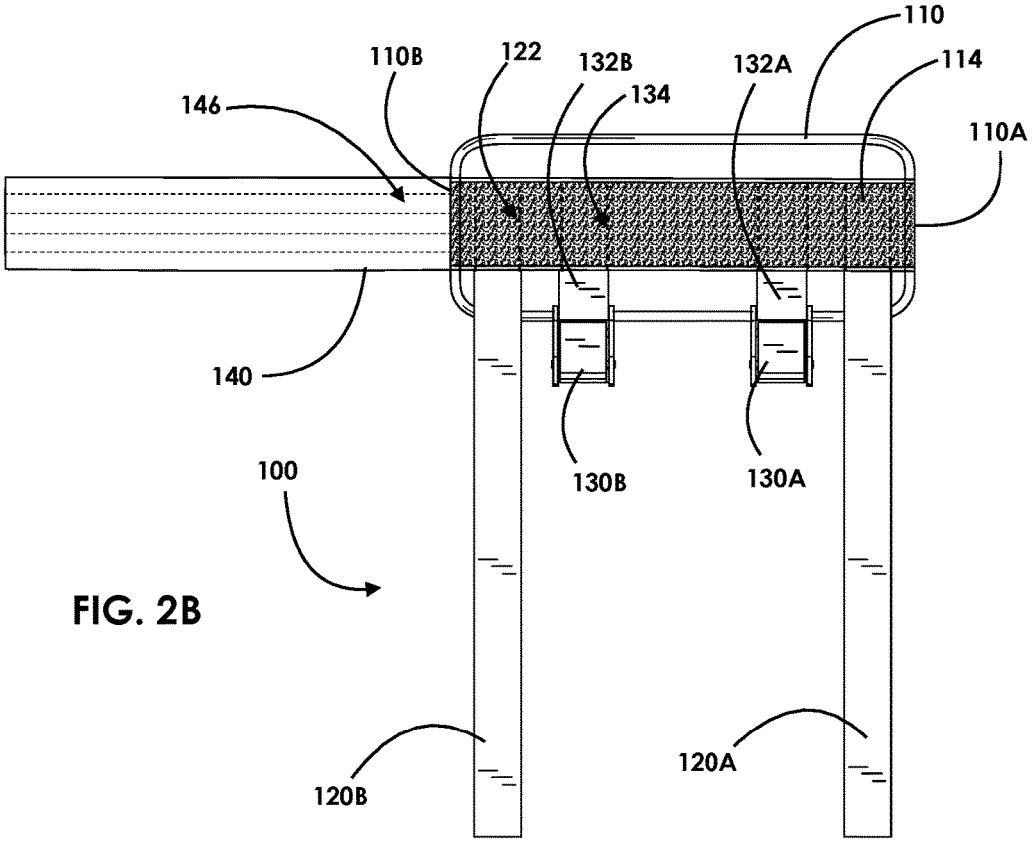
FIG. 2B illustrates a front view for the ankle strap of FIG. 1.
Figure 3A:
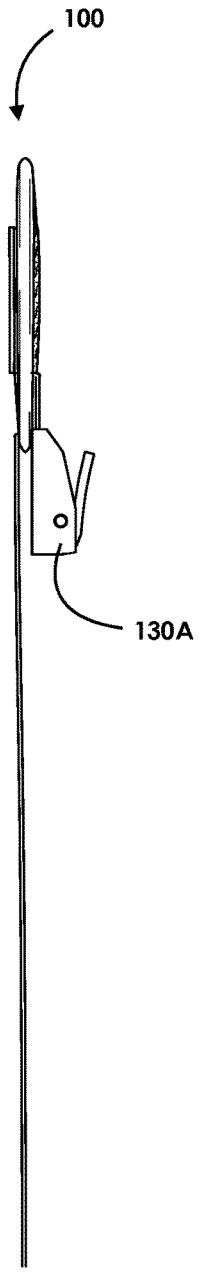
FIG. 3A illustrates a left-side view for the ankle strap of FIG. 1.
Figure 3B:
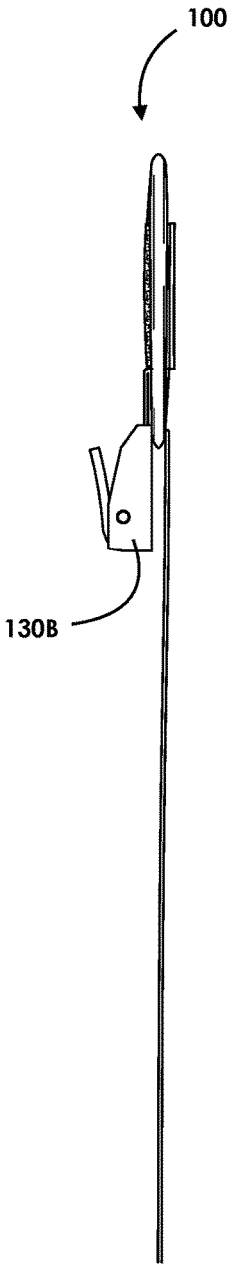
FIG. 3B illustrates a right-side view for the ankle strap of FIG. 1.
Figure 3C:
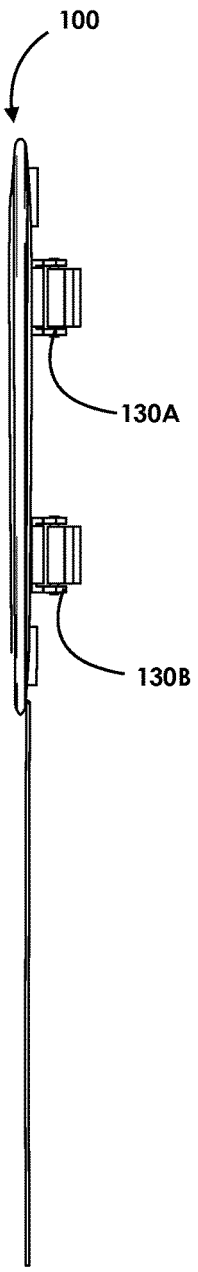
FIG. 3C illustrates a top view for the ankle strap of FIG. 1.
Figure 3D:
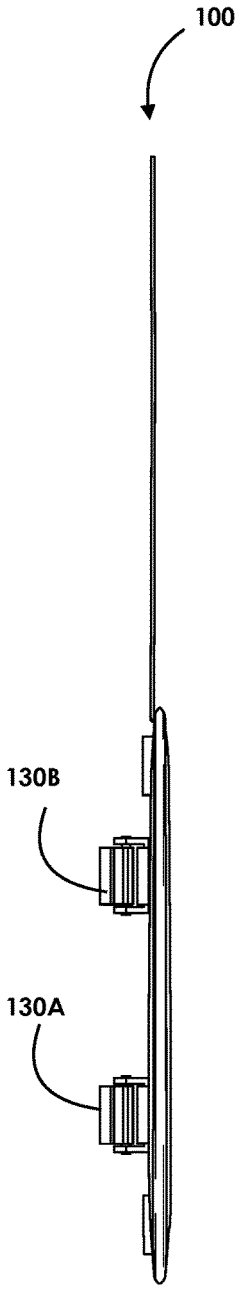
FIG. 3D illustrates a bottom view for the ankle strap of FIG. 1.
Figure 4:
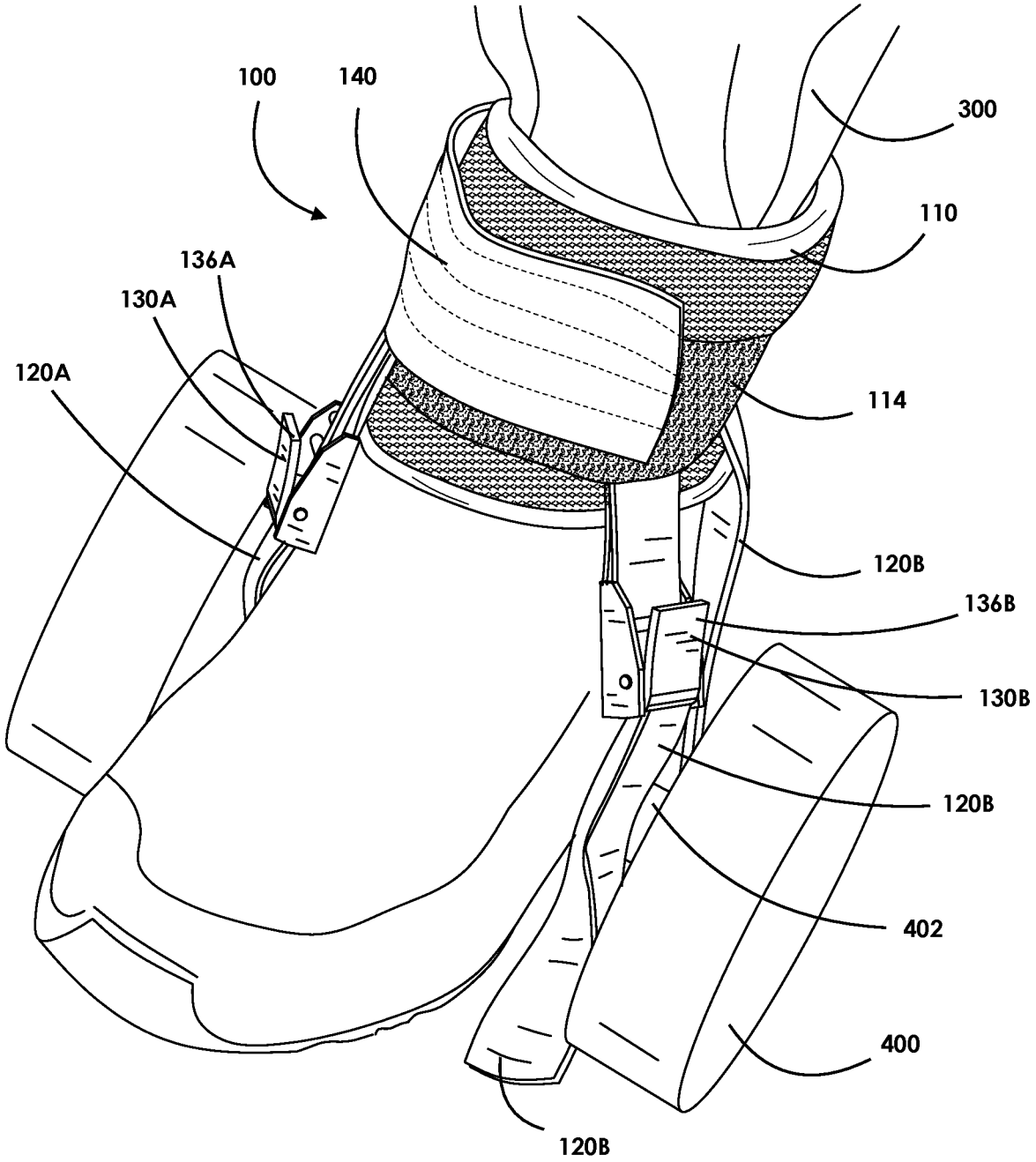
FIG. 4 illustrates a perspective view for the ankle strap of the disclosure described herein shown secured to a user's ankle and a dumbbell weight, according to one non-limiting exemplary embodiment.
Figure 5:
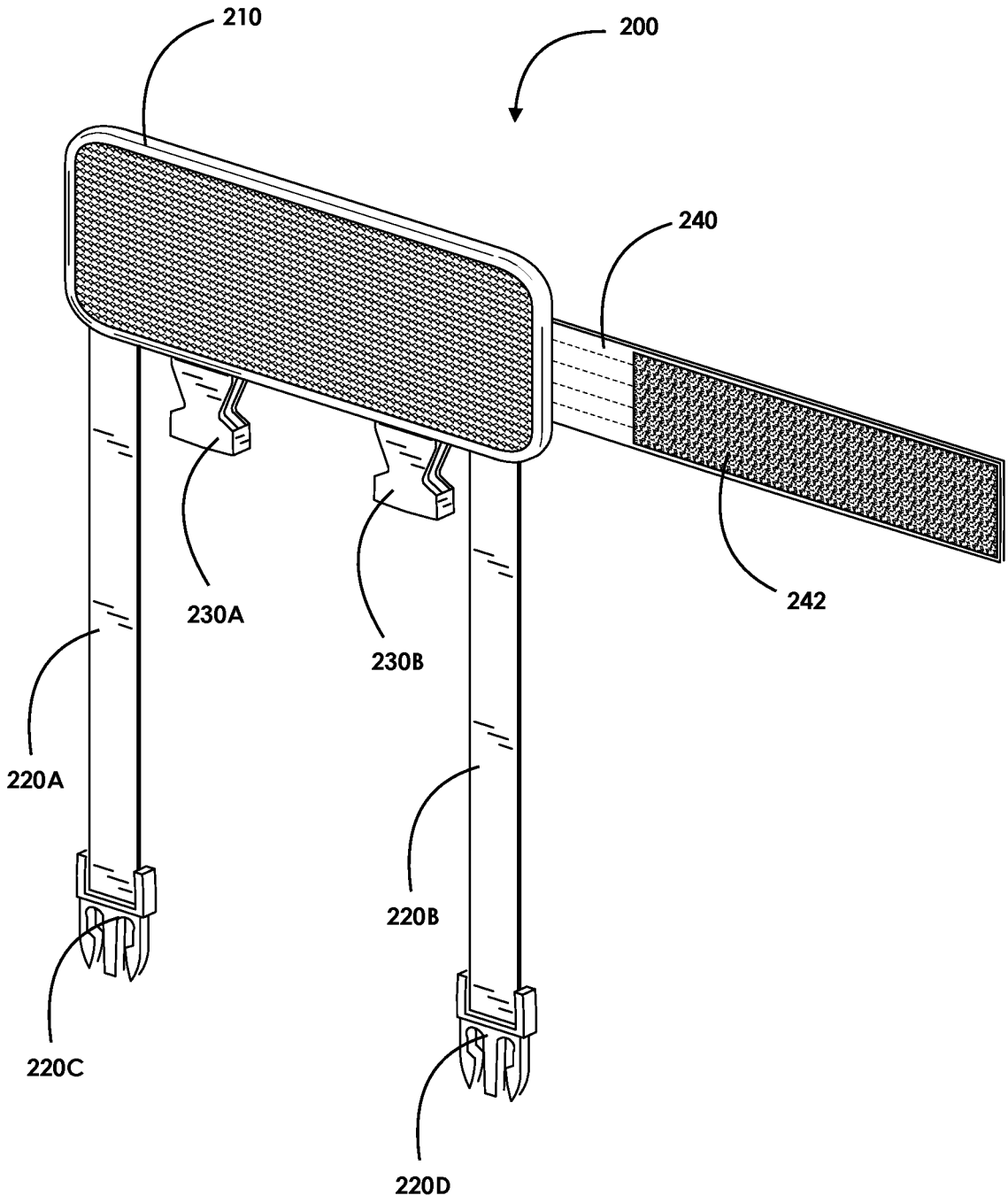
FIG. 5 illustrates a perspective view for another non-limiting exemplary embodiment for the ankle strap of the disclosure described herein.
Figure 6A:
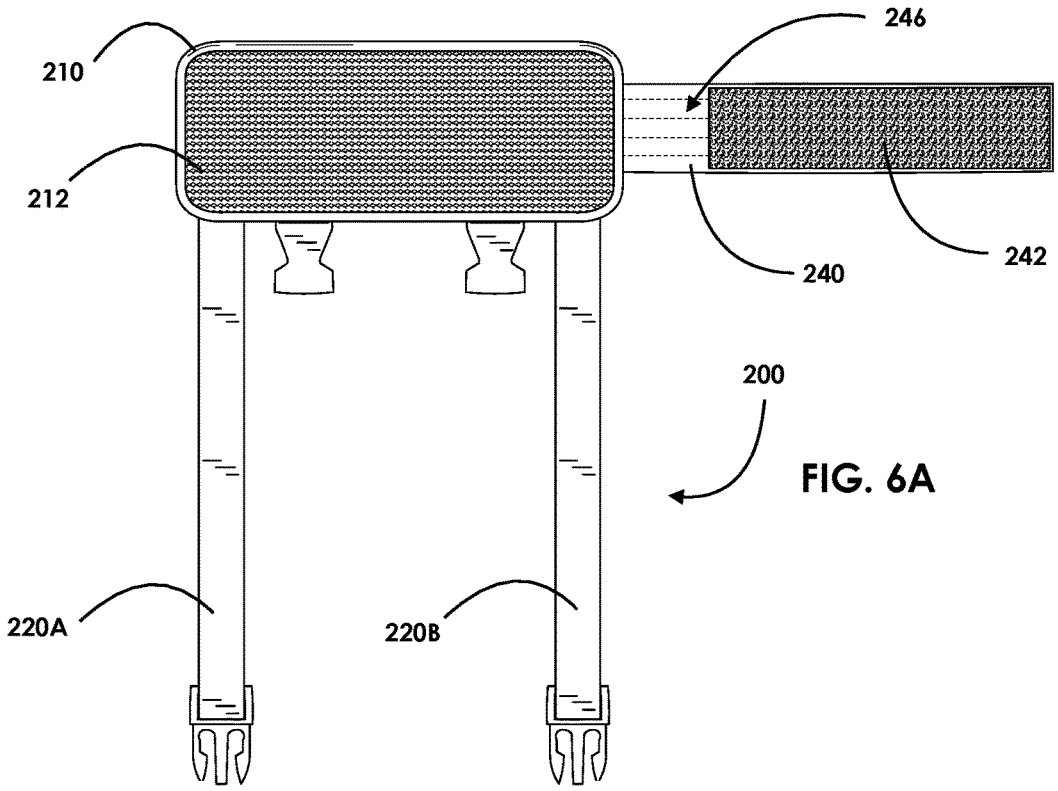
FIG. 6A illustrates a rear view for the ankle strap of FIG. 1.
Figure 6B:
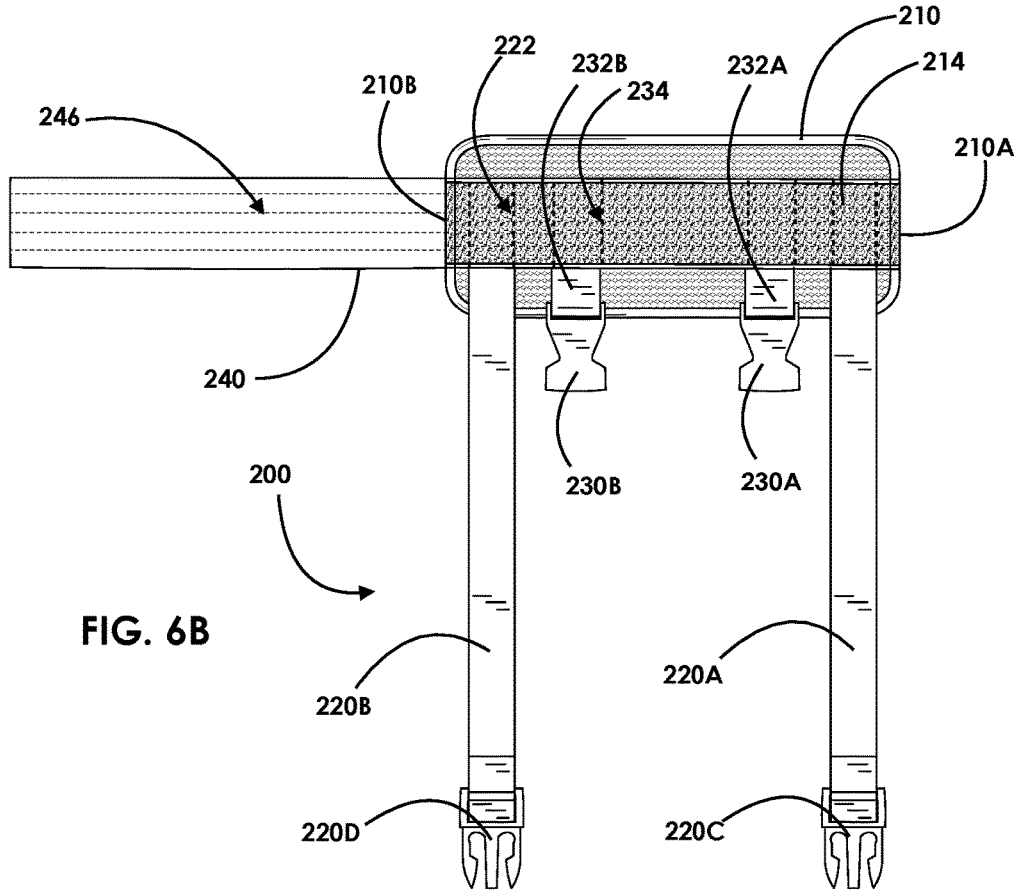
FIG. 6B illustrates a front view for the ankle strap of FIG. 1.
Figure 7A:
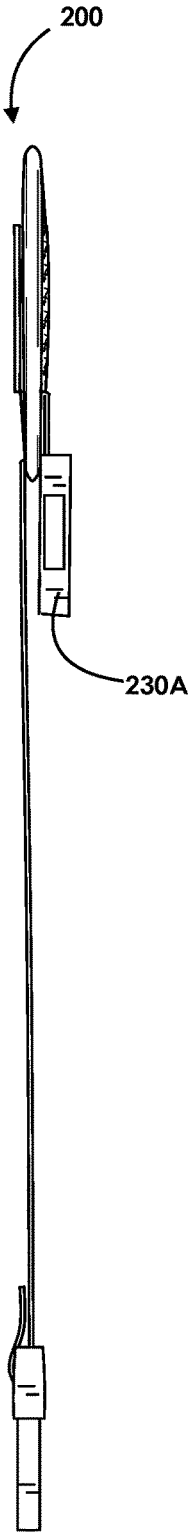
FIG. 7A illustrates a left-side view for the ankle strap of FIG. 1.
Figure 7B:
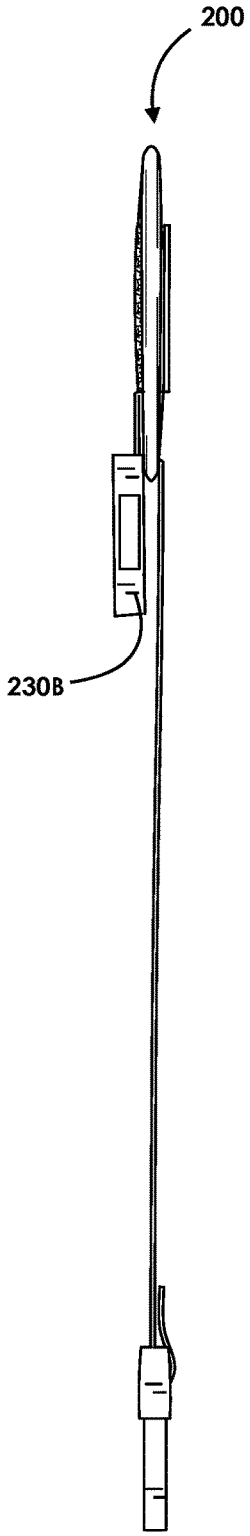
FIG. 7B illustrates a right-side view for the ankle strap of FIG. 1.
Figure 7C:
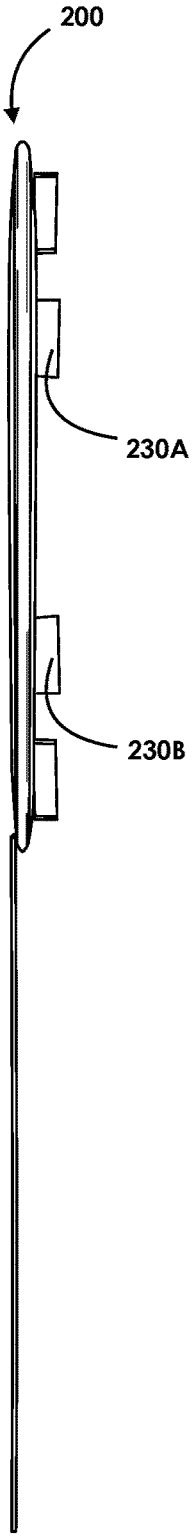
FIG. 7C illustrates a top view for the ankle strap of FIG. 1.
Figure 7D:
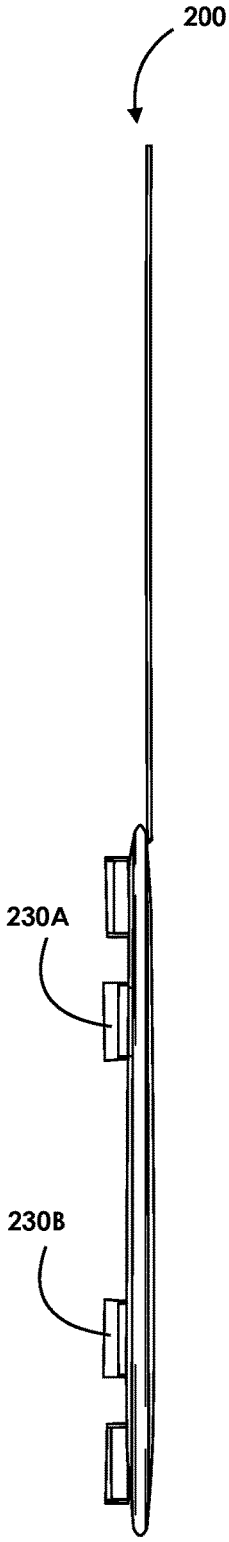
FIG. 7D illustrates a bottom view for the ankle strap of FIG. 1.

FIGS. 1-4 illustrates one non-limiting embodiment of the ankle strap weight securement device of the disclosure described herein. Here, ankle strap 100 is shown having a main body 110 having a rear face that includes a soft padded surface covering member 112 and a front face that includes a hook and loop fastener 114. Here, the interior of body 110 can include any type of additional padding or foam support to improve comfort when ankle strap 100 is secured to a user's ankle, such as shown in FIG. 4. In addition, an ankle or leg side strap 140 is secured to body 110 from end 110B to another opposing end 110A of body 110, and further extends beyond body 110, as shown in FIG. 2B. Here, by securing at least half the length of strap 140 to body 110, strap 140 can be further reinforced to minimize or eliminate any tear or separation of strap 140 from body 110 while ankle strap 100 is secured to weights. In other embodiments, strap 140 may be secured to just one end of body 110, such as end 110B, such as shown in FIG. 2B.

Still referring to FIGS. 1-4, the hook and loop fastener strip 114 can be further secured (via stitching) to body 110 via strap 140 (or alternatively, directly to body 110), wherein fastener strip 114 extends from end 110B to end 110A of body 110. On the other side of strap 140 (the free end), another hook and loop fastener strip 142 can be further secured (via stitching) to strap 140. Here, fasteners strips 114 and 142 are configured to couple and mate with each other, wherein one is comprised of a "hook" and the other is comprised of a "loop", such as Velcro® fastening strips. However, it is contemplated within the scope of the present disclosure described herein any other type of fastener may be used in lieu of or in combination with fasteners 114 and 142, such as buttons, snaps, pins, hooks, magnets, or the like. Here, strap 140 can be further reinforced via multiple stitching 146 that extends laterally from one end to another opposing end of strap 140.

Still referring to FIGS. 1-4, weight securement straps 120A and 120B can be further secured to body 110 via stitching 122. In particular, each of straps 120A and 120B can be disposed below fastener strip 114, or below strap 140 (in the alternative embodiment), and further secured to the front face of body 110. In other embodiments, straps 120A and 120B may be secured to the lower end region or lower edge of body 110. Similarly, buckle fasteners 130A and 130B can be further secured to body 110 via corresponding straps 132A (secured to buckle 130A) and 132B (secured to buckle 130B) and further via stitching 134, such as shown in FIG. 2B. In particular, each of straps 132A and 132B can be disposed below fastener strip 114, or below strap 10) 140 (in the alternative embodiment), and further secured to the front face of body 110. In other embodiments, straps 132A and 132B may be secured to the lower end region or lower edge of body 110. Here, buckles 130A and 130B are comprised of metal spring-loaded cam buckles, however, it is contemplated within the scope of the disclosure described herein that buckles 130A and 130B may be any type of fastener, such as metal or plastic snaps, carabiners, ratchet buckles, roller buckles, side release buckles, snap buckles, tie buckles, shank buckles, frame buckle, O-ring buckles, D-ring buckle, plate buckle, or clasps, among others. For example, in other embodiments, each of straps 120A and 120B may include openings along their length where a prong of a frame buckle can engage any of the openings depending on the desired tightness or length, similar to the securement and tightening of a trouser belt.

FIG. 4 illustrates one non-limiting exemplary embodiment for a method of securing ankle strap 100 to the ankle region of user 300. First, the user can wrap body 110 around his/her ankle, where the rear face of body 110 abuts against the ankle region and the hook and loop fastener strip 114 is facing outwards. Next, the user can then further pull the free end of strap 140 over and around body 110 such that body 110 and strap 140 encircle the user's ankle and are snug around the user's ankle. Next, the user can then couple the hook and loop fastener strip 142 of strap 140 to the hook and loop fastener strip 114 of body 110, thereby securely coupling ankle strap 100 to the user's ankle. Next, the user can place his/her foot on top of a handle 402 of a dumbbell weight 400. Next, the user can then take the ends of each strap 120A and 120B and direct each strap to go under handle 402 from the rear, and further pull each strap upwards towards the front. Next, the user can then direct and route the end of each strap 120A and 120B through its respective buckle 130A and 130B. Specifically, each buckle 130A and 130B can include a spring-loaded lever 136A and 136B, that when depressed, releases/disengages the buckle and allows each strap 10) 120A and 120B to be passed through the buckles. Once a desired tightness is achieved, such as the bottom of the user's foot and shoe firmly pressing against handle 402 (and fitting snugly against it), then the user can release each lever 136A and 136B, thereby securely coupling ankle strap 100 to weight 400.

Figure 8:
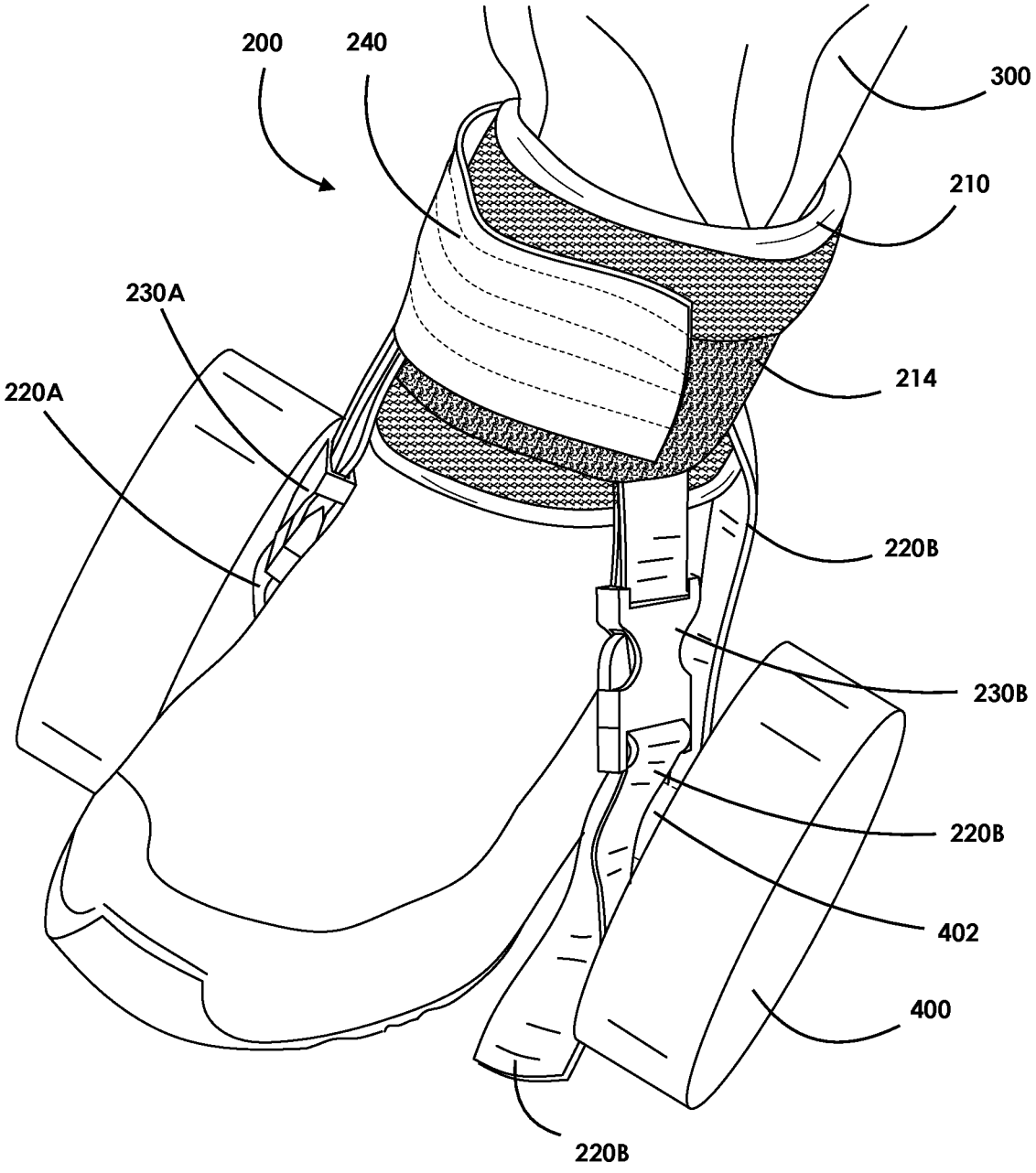
FIG. 8 illustrates a perspective view for the ankle strap of the disclosure described herein shown secured to a user's ankle and a dumbbell weight, according to another non-limiting exemplary embodiment.

FIGS. 5-8 illustrate another non-limiting embodiment of the ankle strap weight securement device of the disclosure described herein. Here, ankle strap 200 is shown having a main body 210 having a rear face that includes a soft padded surface covering member 212 and a front face that includes a hook and loop fastener 214. Here, the interior of body 210 can include any type of additional padding or foam support to improve comfort when ankle strap 200 is secured to a user's ankle, such 20) as shown in FIG. 8. In addition, an ankle or leg side strap 240 is secured to body 210 from end 210B to another opposing end 210A of body 210, and further extends beyond body 210, as shown in FIG. 6B. Here, by securing at least half the length of strap 240 to body 210, strap 240 can be further reinforced to minimize or eliminate any tear or separation of strap 240 from body 210 while ankle strap 200 is secured to weights. In other embodiments, strap 140 may be secured to just one end of body 210, such as end 210B, such as shown in FIG. 6B.

Still referring to FIGS. 5-8, the hook and loop fastener strip 214 can be further secured (via stitching) to body 210 via strap 240 (or alternatively, directly to body 210), wherein fastener strip 214 extends from end 210B to end 210A of body 210. On the other side of strap 240 (the free end), another hook and loop fastener strip 242 can be further secured (via stitching) to strap 240. Here, fasteners strips 214 and 242 are configured to couple and mate with each other, wherein one is comprised of a "hook" and the other is comprised of a "loop", such as Velcro® fastening strips. However, it is contemplated within the scope of the present disclosure described herein that any other type of fastener may be used in lieu of or in combination with fasteners 214 and 242, such as buttons, snaps, pins, hooks, magnets, or the like. Here, strap 240 can be further reinforced via multiple stitching 246 that extends laterally from one end to another opposing end of strap 240.

Still referring to FIGS. 5-8, weight securement straps 220A and 220B can be further secured to body 110 via stitching 122. In particular, each of straps 120A and 120B can be disposed below fastener strip 114, or below strap 140 (in the alternative embodiment), and further secured to the front face of body 110. In other embodiments, straps 220A and 220B may be secured to the lower end region or lower edge of body 210. Further, male member side release buckles 220C and 220D can be coupled to the opposing ends of straps 220A and 220B. Similarly, female member fastening members 230A and 230B can be further secured to body 210 via corresponding straps 232A (secured to member 230A) and 232B (secured to member 230B) and further secured to body 210 via stitching 234. In particular, each of straps 232A and 232B can be disposed below fastener strip 214, or below strap 240 (in the alternative embodiment), and further secured to the front face of body 210. In other embodiments, straps 232A and 232B may be secured to the lower end region or lower edge of body 210. Here, female members 230A and 230B are configured to receiving and securely engagement male members 220C and 220D, respectively. Here, members 230A, 230B, 220C, and 220D are comprised of side release fastener buckles, however, it is contemplated within the scope of the disclosure described herein that buckles 130A and 130B may be any type of fastener, such as metal or plastic snaps, carabiners, ratchet buckles, roller buckles, cam buckles, snap buckles, tie buckles, shank buckles, frame buckles, O-ring buckles, D-ring buckles, plate buckles, or clasps, among others. For example, in other embodiments, each of straps 220A and 220B may include openings along their length where a prong of a frame buckle can engage any of the openings depending on the desired tightness or length, similar to the securement and tightening of a trouser belt.

FIG. 8 illustrates one non-limiting exemplary embodiment for a method of securing ankle strap 200 to the ankle region of user 300. First, the user can wrap body 210 around his/her ankle, where the rear face of body 210 abuts against the ankle region and the hook and loop fastener strip 214 is facing outwards. Next, the user can then further pull the free end of strap 240 over and around body 210 such that body 210 and strap 240 encircle the user's ankle and are snug around the user's ankle. Next, the user can then couple the hook and loop fastener strip 242 of strap 240 to hook and loop fastener strip 214 of body 210, thereby securing coupling ankle strap 200 to the user's ankle. Next, the user can place his/her foot on top of a handle 402 of a dumbbell weight 400. Next, the user can then take the end of each strap 220A and 220B and direct each strap to go under handle 402 from the rear, and further pull each strap upwards towards the front. Next, the user can then couple members 220C and 220D with that of members 230A and 230B, respectively. Next, the user can then adjust the length of straps 220A and 220B via their respective buckles 220C and 220D until a desired tightness is achieved, such as the bottom of the user's foot and shoe pressing against handle 402 (and fitting snugly against it), thereby securely coupling ankle strap 200 to weight 400. If needed, the user may decouple members 220C and 220D from members 230A and 230B in order to further adjust the length of straps 220A and 220B (or straps 232A and 232B).

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. An exercise ankle strap for securement to a weight, comprising:

a body comprised of a rectangular configuration and having a front face, a rear face, a first end, and a second end;

a first fastener secured to the front face of the body, wherein the first fastener extends from the first end to the second end of the body and wherein the first fastener at least partially covers the front face of the body;

a side strap secured to the body and extending from the body; and a second fastener secured to the side strap;

a first strap and a second strap coupled to the body, wherein the first strap and second strap extend below the body and each are configured to at least partially wrap around a weight; a third strap and a fourth strap coupled to the body, wherein the third and fourth straps are shorter in length then the first and second straps, and wherein the third and fourth straps are both disposed between the first and second straps; and a third fastener and a fourth fastener, wherein the third fastener is coupled to the third strap and the fourth fastener is coupled to the fourth strap.

2. The exercise ankle strap of claim 1, wherein the third strap is at least partially received within the third fastener and the fourth strap is at least partially received within the fourth fastener.

3. The exercise ankle strap of claim 2, further comprising:

a fifth fastener coupled to the first strap; and a sixth fastener coupled to the second strap.

4. The exercise ankle strap of claim 3, wherein the third fastener at least partially receives the fifth fastener, and the fourth fastener at least partially receives the sixth fastener.

5. The exercise ankle strap of claim 1, wherein the first and second fasteners are comprised of hook and loop fasteners.

6. The exercise ankle strap of claim 1, wherein the side strap is coupled to the first end or second end of the body.

7. The exercise ankle strap of claim 1, wherein the side strap is coupled to the body from the first end to the second end.

8. An exercise ankle strap for securement to a weight, comprising:

a body having a front face, a rear face, a first end, and a second end;

a first fastener secured to the front face of the body, wherein the first fastener extends from the first end to the second end of the body and wherein the first fastener at least partially covers the front face of the body;

a side strap secured to the body and extending from the body;

a second fastener secured to the side strap;

a first strap and a second strap coupled to the body, wherein the first strap and second strap extend below the body;

a first fastener coupled to the first strap and a second fastener coupled to the second strap;

a third strap and a fourth strap coupled to the body, wherein the third and fourth straps are shorter in length than the first and second straps, and wherein the third and fourth straps are both disposed between the first and second straps; and a third fastener coupled to the third strap and a fourth fastener coupled to the fourth strap.

9. An exercise ankle strap for securement to a weight, comprising:

a body having a front face, a rear face, a first end, and a second end;

a first fastener secured to the front face of the body, wherein the first fastener extends from the first end to the second end of the body and wherein the first fastener at least partially covers the front face of the body;

a side strap secured to the body and extending from the body;

a second fastener secured to the side strap;

a first strap and a second strap coupled to the rear face of the body, wherein the first strap and the second strap extend below the body;

the first strap coupled to a first securement member and the second strap coupled to a second securement member;

a third strap and a fourth strap coupled to the rear face of the body, wherein the third and fourth straps are shorter in length than the first and second straps, and wherein the third and fourth straps are both disposed between the first and second straps; and the third strap coupled to a third securement member and the fourth strap coupled to a fourth securement member, wherein the third securement is adapted to couple to the first securement member and the fourth securement member is adapted to couple to the second securement member.

* * * * *